US011786087B2

(12) United States Patent
Buckingham

(10) Patent No.: US 11,786,087 B2
(45) Date of Patent: Oct. 17, 2023

(54) TOILET FRAME

(71) Applicant: Christine Anne Buckingham, Poole (GB)

(72) Inventor: Christine Anne Buckingham, Poole (GB)

( * ) Notice: Subject to any disclaimer, the term of this patent is extended or adjusted under 35 U.S.C. 154(b) by 0 days.

(21) Appl. No.: 17/477,115

(22) Filed: Sep. 16, 2021

(65) Prior Publication Data

US 2022/0079399 A1 Mar. 17, 2022

(30) Foreign Application Priority Data

Sep. 17, 2020 (GB) ..... 2014689

(51) Int. Cl.
*A47K 17/02* (2006.01)

(52) U.S. Cl.
CPC ..... *A47K 17/026* (2013.01); *A47K 17/028* (2013.01)

(58) Field of Classification Search
CPC .. A61H 3/00; A61H 2003/002; A61G 7/1007; A61G 5/14; A47K 17/028; A47K 17/026
See application file for complete search history.

(56) References Cited

U.S. PATENT DOCUMENTS 1,067,767 A * 7/1913 Simonson ..... A47K 17/028 297/DIG. 10
5,499,645 A * 3/1996 Baliga ..... A61H 3/00 135/77
5,933,877 A 8/1999 Wu
6,886,575 B2 * 5/2005 Diamond ..... A45B 7/00 403/321
10,583,066 B1 3/2020 Abroms
10,835,433 B2 * 11/2020 Schwab ..... A61G 7/1007
11,191,400 B2 * 12/2021 Lopez ..... A47K 17/026
2004/0020525 A1 * 2/2004 Lev ..... A61H 3/04 135/66
2008/0121258 A1 * 5/2008 Lin ..... A61H 3/00 135/74
2015/0113719 A1 * 4/2015 Good ..... A47K 17/028 4/254

FOREIGN PATENT DOCUMENTS

CN 202036144 * 11/2011 ..... A47K 17/02
CN 202036144 U 11/2011
ES 1103882 U 3/2014
GB 2190004 A 11/1987
GB 2177735 B 5/1988
GB 2427207 * 12/2006 ..... A47K 17/02
GB 2427207 B 9/2010
KR 200490704 Y1 12/2019
WO 2007012678 A1 2/2007

OTHER PUBLICATIONS

UK Search and Examination Report dated Mar. 8, 2021 for GB2014689.0.

* cited by examiner

*Primary Examiner* — David P Angwin
*Assistant Examiner* — Nicholas A Ros
(74) *Attorney, Agent, or Firm* — Christopher M. Ramsey; GrayRobinson, P.A.

(57) ABSTRACT

A toilet frame includes a left side frame, a right side frame, and a crossbar that connects the left and ride side frames at the front of the toilet frame. Each of the left and right side frames is movable between a folded position and an unfolded position. The left and right side frames are not connected by a crossbar at the back of the toilet frame.

9 Claims, 3 Drawing Sheets

TOILET FRAME

CROSS-REFERENCE TO RELATED APPLICATION

This claims the benefit of priority from GB Application No. 2014689.0, filed Sep. 17, 2020, which is incorporated by reference in its entirety.

FIELD

This pertains generally to the field of toilet frames, and in particular folding toilet frames for travel and convenience.

BACKGROUND

People with mobility issues, such as the elderly and infirm, find it hard to use the toilet. They find it a challenge to align themselves with the toilet seat by reversing into position, to lower themselves onto the toilet seat from a standing position, and to lift their body back to standing once they have finished.

It is known to provide handrails or a frame around a toilet so that people can use their arm strength to help raise and lower themselves between a standing and seated position. Typically, such frames need to be secured to the walls or floor, often with permanent fixings such as screws. These arrangements of handrails and/or frames become a permanent fixture within the home, which may be undesirable when a toilet is shared with other family members. They also do not solve the problems encountered when using a toilet away from home, as the frame cannot be transported with a user.

Many users may make use of their existing walking aids such as mobility frames or walking sticks, to provide them with some stability with aligning themselves and reversing into position, and whilst raising and lowering between standing and seated position. However, walking frames are not typically designed to fit around a toilet. They are not intended to provide stability when raising and lowering, and in fact may tip if a user is unbalanced. They may also interfere with the workings of the toilet such as the cistern and flush. Walking aids such as mobility frames that are wheeled to assist movement are particularly unsuitable for use in providing support at a toilet. It is very important that any device for providing support at a toilet engages the ground (or supporting surface) in a firm and stable manner.

The prior art shows a number of devices which attempt to address these needs in various ways.

There are some toilet frames on the market that are specifically designed for use when using the toilet. The majority of these comprise side frame portions, joined together by a rear crossbar, that sits at the back of the toilet when in position. Whilst this crossbar arrangement does provide some stability for the user, bracing the two side frames together, it is often most inconvenient when a user needs to wipe themselves. The majority of these toilet frames tend not to be adjustable in size to cater for different heights and sizes of both users, and toilets. Those that are in some way adjustable, typically incorporate telescopic legs to allow for different heights. A user must set the same height on each of the four legs prior to use. A challenging task for a user that may be somewhat unstable on their feet.

Toilets cisterns are multi varied—much more than they used to be. There are close coupled versions and built-in versions so there is a lot less room at the rear of the designs. So in some cases the user has to place the rear crossbar of a current frame forward of the cistern and the only way to do this is to raise the toilet seat and place the frame crossbar in front of the raised toilet lid. For the user, this means they are leaning against the raised toilet lid which is most uncomfortable and restrictive to wiping, plus there is a risk of the seat falling forward.

GB 2 427 207 (Buckingham et al) discloses a toilet frame comprising a pair of side frame members connected together by a link member or crossbar at the back, and a pair of footplates at the front. A user places the frame in position surrounding the toilet, with the crossbar at the back, in close proximity to the cistern in a typical toilet arrangement. The user leans on the armrests, to reverse into position, and lowers themselves onto the seat. Their feet are placed on the footplates for added stability. Whilst providing a somewhat stable arrangement for a user when maneuvering onto and off a toilet, where footplates help to prevent the frame from tipping should the user be unbalanced, should the user lean heavily on one side, the frame may tip.

Whilst the frame comprises four legs that incorporate telescopic height adjusting means, a user is required to adjust each of these to the same height prior to use. This toilet frame also incorporates a rear crossbar which can interfere with toilet usage, when flushing and in particular when wiping.

BRIEF SUMMARY

Preferred embodiments of the present invention aim to provide a frame for providing support and stability when using a toilet, that is portable and can be easily transported for use when traveling. Preferred embodiments aim to also provide a frame that can be adjusted in both width and height, by a convenient means, to ensure user comfort for users of different heights and toilets of different dimensions. Preferred embodiments also aim to provide a frame that keeps the rear area clear, to allow a user to comfortably use a toilet, particularly when wiping and flushing.

According to one aspect of the present invention, there is provided a toilet frame comprising a left side frame; a right side frame; and a crossbar that connects the left and ride side frames at the front of the toilet frame: wherein each of the left and right side frames is movable between a folded position and an unfolded position; and the left and right side frames are not connected by a crossbar at the back of the toilet frame.

Preferably, each of the side frames may be pivotally connected to the crossbar, in a folded position extends alongside the crossbar, and in an unfolded position extends transversely of the crossbar.

Preferably, the length of the crossbar may be adjustable to adjust the width of the toilet frame.

Preferably, each of the side frames may be provided with a respective armrest.

Preferably, the height of each of the armrests may be adjustable.

Each of the armrests may be mounted on a single support that is adjustable in height at an upper part of the respective side frame.

Each of the side frames may have a respective front leg of which a bottom part extends outwardly from the side frame, to the side of the toilet frame.

Preferably, each of the side frames has a respective rear leg of which a bottom part extends outwardly from the side frame, to the side of the toilet frame.

The or each said bottom leg part is preferably provided with a respective anti-slip ferrule.

Preferably, a footplate may be secured to the toilet frame such that a user can stand on the footplate.

Preferably, the footplate may be movably secured to a lower part of one of the side frames and/or crossbar, such that the footplate can be moved between an operative position and a stowed position.

The frame may comprise two of said footplates, one for each foot.

In a further aspect of the present invention, there is provided a toilet with a toilet frame as hereinbefore described, positioned around the toilet to support a user via the left and right side frames.

In yet a further aspect of the present invention, there is provided a method of using a toilet, comprising the steps of positioning a toilet frame around the toilet, such that a user is supported via the left and right side frames.

BRIEF DESCRIPTION OF THE DRAWINGS

For a better understanding of the invention and to show how embodiments of the same may be carried into effect, reference will now be made, by way of example, to the accompanying diagrammatic drawings, in which.

In the figures like references denote like or corresponding parts.

DETAILED DESCRIPTION

In the context of this specification, the term "toilet frame" means a support frame for use with a toilet to assist a user in sitting down on the toilet and getting up again from a sitting position. In this specification, terms of position such as left, right, front and back are used to denote positions relative to a user sitting on a toilet.

Figure 1:
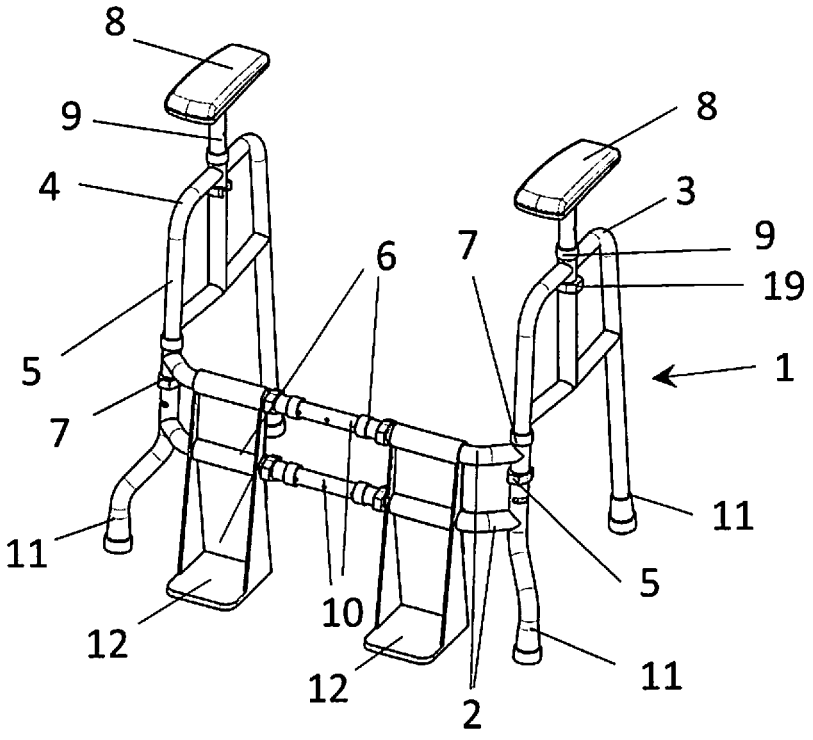
FIG. 1 shows one embodiment of toilet frame in an unfolded position, shown in isometric view, with a pair of footplates.

FIG. 1 shows one possible configuration of toilet frame 1 showing a left side frame 3 and a right side frame 4 connected together by at least one connector in the form of a crossbar 2. The crossbar 2 may comprise a planar member, not shown, or a pair of parallel, tubular crossbars 6, as shown. The left side frame 3 and the right side frame 4 are rotatably secured to the crossbar 2, such that the left side frame 3 and the right side frame 4 can be rotated in a horizontal plane from an unfolded position to a folded position. FIG. 1 shows the unfolded position, where the toilet frame 1 is ready for use.

The toilet frame 1 incorporates an armrest 8 at the top of the left side frame 3 and the right side frame 4, such that the user can rest their arms across or over these armrests, when raising or lowering themselves onto a toilet seat, and may also grip these armrests 8 when maneuvering the toilet frame 1 into position surrounding the toilet. These armrests 8 may also be used when rotating the left side frame 3 and the right hand side frame 4 in relation to the crossbar 2, to take the toilet frame 1 between folded and unfolded positions.

Figure 5:
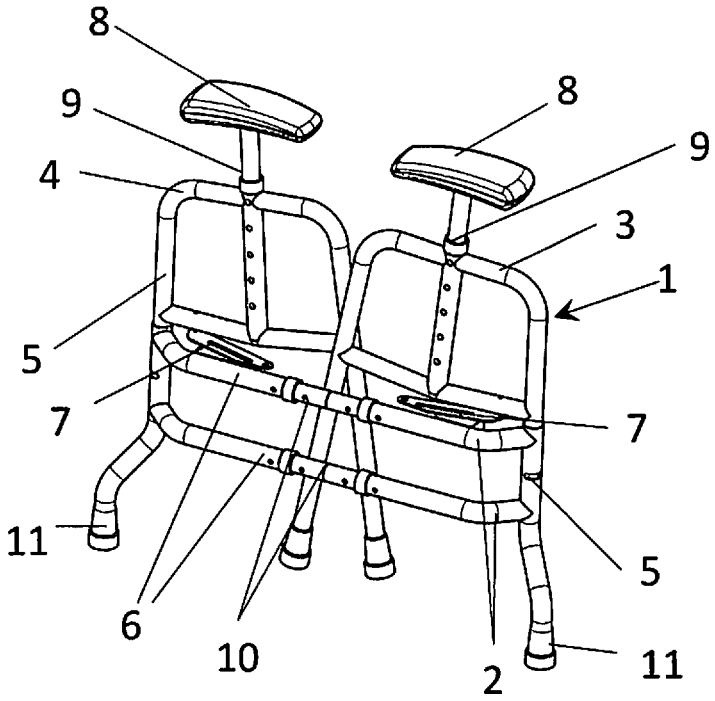

The left side frame 3 and the right side frame 4 each comprise a pair of legs, with a front leg 5 of each being connected to the crossbar 2. These front legs 5 incorporate a pivot 7 or means to allow the left side frame 3 and right side frame 4 to pivot between an unfolded and a folded position. This pivot 7 on each side may comprise an inner tubular part of leg 5 that sits inside an outer tubular part of leg 5, such that one can rotate about the other. It may comprise a hinged stay (as shown in FIG. 5), or alternatively it may comprise a C-clip that engages around the outer tubular part and has a projection that passes through a hole in the outer tubular part to engage a hole in the inner tubular part to hold the respective side frame 4 in either an unfolded or folded position. Such C-clips can be seen in FIGS. 1 and 2 on the legs 5, below the ends of the upper crossbar 6.

Thus, as may be seen in the drawings, each of the side frames 3,4 has a respective front leg 5 with an upright portion to which the crossbar 2 is connected to allow the side frames 3,4 to pivot between their folded and unfolded positions. Thus, in this embodiment, the lower front leg portions 5 remain solidly connected to the crossbars 2,6, whilst the upper front leg portions 5, along with the remainder of the side frames 3,4, pivot with respect to the lower front leg portions 5.

The crossbar 2 in one embodiment incorporates width adjusting means 10, whereby the distance between front legs 5 can be increased or decreased. This allows the width of the toilet frame 1 to be varied to allow for different shapes and sizes of toilet about which the toilet frame 1 sits, and to also allow for different widths of users. Likewise, the armrests 8 are joined to the left side frame 3 and the right side frame 4 by a height adjusting means 9, such that the armrests 8 can be raised or lowered to be in a comfortable position for the user, and to again allow for different height requirements of different users. By having the height adjusting means 9 at waist height, and by having this height adjusting means 9 within the armrests 8 rather than in all four legs, this allows the height of the armrests 8 to be conveniently adjusted by the user, requiring less steps with just two height adjusting means 9 to alter. The user can even adjust the height of the armrests 8 when seated on the toilet. There is no need to turn the toilet frame 1 upside down to adjust each leg in turn, requiring much dexterity and strength. The height of the armrests 8 is key to user experience. The user presses down on these armrests 8 to maneuver themselves from a seated to a standing position. It is therefore key that these armrests 8 are not too low or too high, but easily adjustable for different heights of user. This is key where the toilet frame 1 is used by more than one user.

Figure 2:
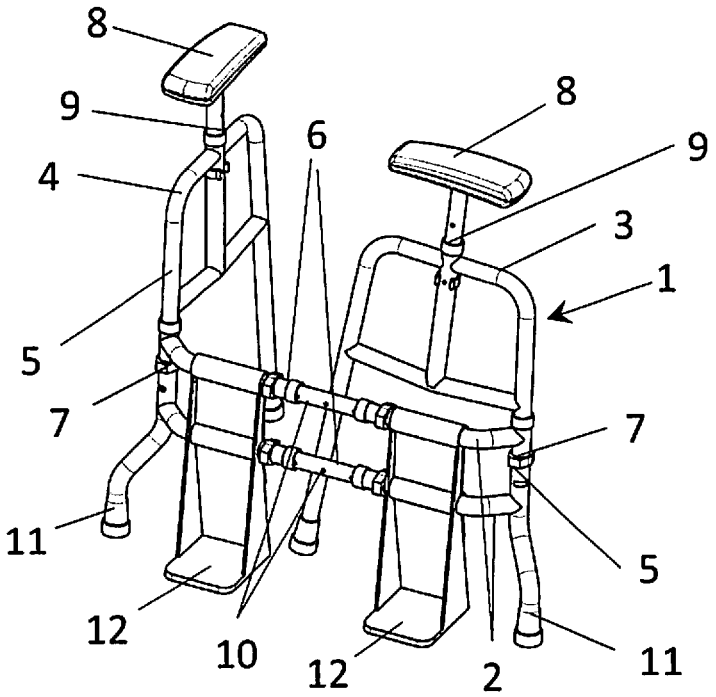
FIG. 2 shows the toilet frame of FIG. 1 in a part folded position, showing a left side frame extending along a crossbar.

As may be seen in FIGS. 1 and 2, each height adjusting means 9 may comprise inner and outer tubular parts to provide a telescopically adjustable support for the respective armrest 8. To fix the height of the height adjusting means 9, a C-clip 19 may engage around the outer tubular part, with a projection that passes through a hole in the outer tubular part to engage a hole in the inner tubular part. Such C-clips 19 can be seen in FIGS. 1 and 2 on the height adjusting means 9, below the upper horizontal members of the side frames 3 and 4.

Although it is convenient to have just a single height adjusting means 9 for each armrest 8, more than one height adjusting means 9 for each armrest 8 may be provided.

The front legs 5 and the rear legs may incorporate an anti-slip ferrule in the form of a foot 11 on their lowermost end that engages with the floor. This foot 11 may comprise a rubber material, or similar material that provides additional grip and helps to prevent slip of the toilet frame 1 when in use. The front legs 5 and/or the back legs may be splayed at an angle, either out to each side of the toilet frame 1 or out in a forward direction to the toilet frame 1, to increase the ground-engaging area of the toilet frame 1 and therefore help to prevent it from tipping. Should the user lean on one armrest 8 more than on the other armrest at any one time, the splayed legs will help to prevent the toilet frame 1 from tipping towards that side. The splayed legs increase the base of support and thus increase the stability.

The toilet frame 1 may incorporate one or more footplate 12. The user, once in position on the toilet seat, can place their feet onto the footplates, to help to hold the toilet frame 1 in position, and provide additional stability. This is particularly useful when the user is moving from a seated to a standing position, where their weight helps to maintain the toilet frame 1 in the same position, preventing any lateral movement.

An aim of the footplate 12 is to provide a ground support to stop the frame 1 from tipping. Someone who has had a stroke and has a weakness on one side may press down unequally and tip the frame. If their opposing foot was resting in the footplate 12, the weight of their leg would counterbalance this.

FIG. 2 shows the toilet frame of FIG. 1 with the left side frame 3 in a folded configuration. The left side frame 3 has pivoted or rotated about the pivot 7 such that the left side frame 3 has been moved by the user from an unfolded position, at 90 degrees or approximately perpendicular to the crossbar 2, and into a folded position, where it sits alongside the crossbar 2. The toilet frame 1 may be provided with a clip, not shown, to hold the left side frame 3 and the right side frame 4 in position when in a folded position. This clip may comprise a push-fit moulded portion, a hook, or alternative means of releasably securing the frame of the toilet frame 1 such that the left side frame 3 and right side frame 4 do not come unfolded when being moved in a folded position.

Figure 3:
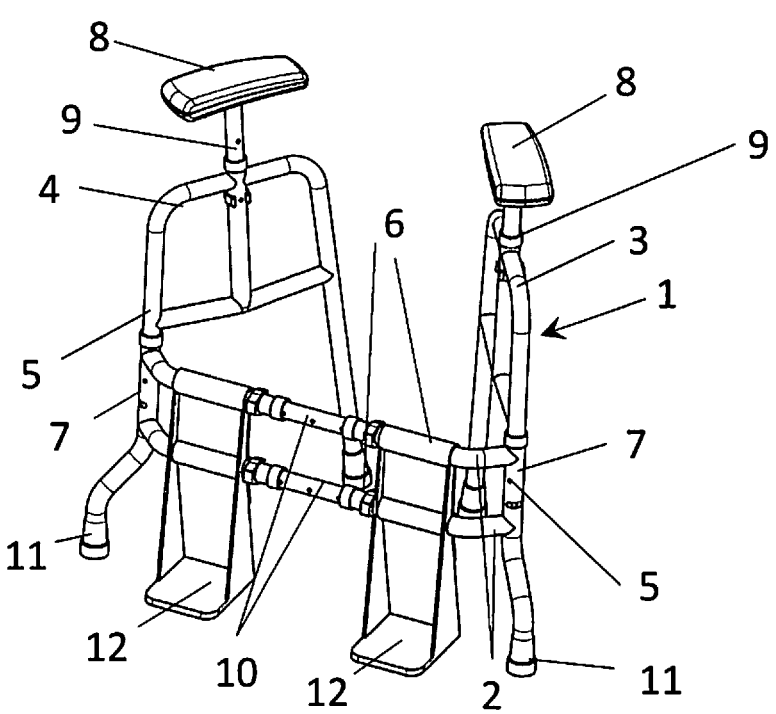
FIG. 3 shows the toilet frame of FIGS. 1 and 2, with both the left side frame and a right side frame in part folded position.
Figure 4:
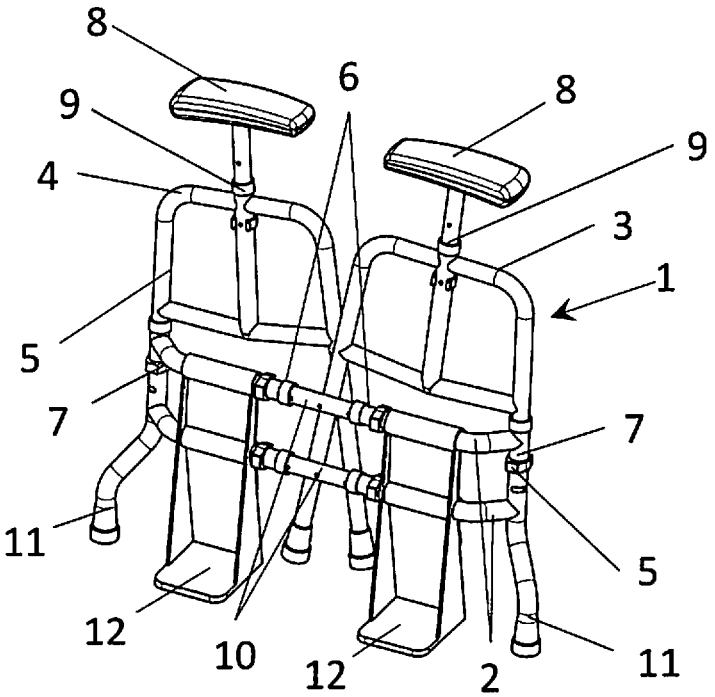
FIG. 4 shows the toilet frame of FIGS. 1 to 3 in a folded position, with both the left side frame and the right side frame extending along the crossbar; and, FIG. 5 shows the toilet frame in a folded position, without footplates.

FIG. 3 shows the left side frame 3 and the right side frame 4 in a part folded position, and FIG. 4 shows the toilet frame 1 in a fully folded position, where both left side frame 3 and right side frame 4 are alongside the crossbar 2. FIG. 5 shows the toilet frame 1 in the same folded position, but without the footplates 12. In a folded configuration, the toilet frame 1 is designed with as small as footprint as possible. The toilet frame 1 is fully operational without the footplates 12, as these are there to provide additional support to a user when in the seated position on the toilet seat, and when moving between a standing and seated position.

The toilet frame 1 may be made from tubular metal material, that has been bent into shape, such as steel or aluminium, for example. The left side frame 3 and the right side frame 4 may each comprise a U-shaped bent piece of tubular metal.

To use the toilet frame 1, the user must first unfold the left side frame 3 and the right side frame 4. Where a clip has been provided to hold these in a folded position, this would need to be unfastened, or where the clip is a push-fit, a small force would be require to pull the left side frame and/or right side frame 4 away from the crossbar 2. The user can adjust the width adjusting means 10 to allow for sufficient space between the left side frame 3 and the right side frame 4 for them to comfortable gain access, whilst also taking into account the width of the toilet and the space available on either side. The width adjusting means 10 may comprise holes in an inner tubular part and an outer tubular part that are telescopically adjustable and may be held in position by respective C-clips (of the type described previously), to ensure rigidity of the frame in use, and prevent splay. The user can also raise or lower the armrests 8 so that they are at a comfortable height for leaning on or over, to carry some of their weight. Width adjustment is also beneficial when a toilet frame 1 is to be reissued to a new user, who may have different width requirements.

Once the toilet frame 1 is in an unfolded position, it is ready for use. The user stands within the footprint of the unfolded toilet frame 1, and maneuvers themselves so that they can reverse into position in front of the toilet, with their back to the toilet. The user is taught to reverse until they can feel the toilet behind their knees, where they can then lower themselves onto the seat. The armrests 8 are in a suitable plane for ease of locating them, and may be at an angle such that when the user pushes down, the frame doesn't tip forwards. Whilst making use of the armrests 8, and optionally any available footplates 12, the user can lower themselves into a seated position on the toilet seat. The rear of the toilet frame 1 is completely clear, without any further connectors or crosspieces, which allows the user to tend to themselves, and to flush the toilet. They can then return to a standing position by pushing down on the armrests 8 as leverage.

In this specification, the verb "comprise" has its normal dictionary meaning, to denote non-exclusive inclusion. That is, use of the word "comprise" (or any of its derivatives) to include one feature or more, does not exclude the possibility of also including further features. The word "preferable" (or any of its derivatives) indicates one feature or more that is preferred but not essential.

All or any of the features disclosed in this specification (including any accompanying claims, abstract and drawings), and/or all or any of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

That which is claimed is:

1. A toilet frame comprising a left side frame, a right side frame, and a crossbar that connects the left side frame and right side frame at a front of the toilet frame; wherein each of the left side frame and right side frame is movable between a folded position in which the left side frame and right side frame respectively extend alongside the crossbar and an unfolded position in which the left side frame and right side frame respectively extend transversely of the crossbar; and the left side frame and right side frame are not connected by a crossbar at a back of the toilet frame; wherein:

each of the left side frame and right side frame, respectively, has a front leg having a front leg lower part that is fixed relative to the crossbar and extends outwardly from the respective left side frame or right side frame, to a side of the toilet frame, thereby enlarging a width of the toilet frame at the front of the toilet frame;

each of the front legs has an upper part that pivots with respect to the front leg lower part, along with the rest of the respective left side frame or right side frame, when the respective left side frame or right side frame moves between the folded position and unfolded position;

the left side frame includes a left side armrest a height of which is adjustable relative to the left side frame; and the right side frame includes a right side armrest, the height of which is adjustable relative to the right side frame.

2. The toilet frame of claim 1, wherein a length of the crossbar is adjustable to adjust a width of the toilet frame.

3. The toilet frame of claim 1, wherein, the left side armrest is mounted on a single left side support and the right side armrest is mounted on a single right side support, the left side support and right side support being adjustable in height at an upper part of the left side frame and an upper part of the right side frame, respectively.

4. The toilet frame of claim 1, wherein the front leg lower part of the respective front leg of each of the left side frame and right side frame includes a respective anti-slip ferrule.

5. In combination, a toilet and the toilet frame of claim 1, positioned around the toilet to support a user via the left side frame and right side frame.

6. The toilet frame of claim 1, further comprising a footplate that is secured to the toilet frame such that a user can stand on the footplate.

7. The toilet frame of claim 6, wherein the footplate is movably secured to a lower part of one of the left side frame and right side frame and/or the crossbar, such that the footplate can be moved between an operative position and a stowed position.

8. The toilet frame of claim 6, comprising two said footplates, one for each foot.

9. A method of using a toilet, comprising positioning the toilet frame of claim 1 around the toilet, such that a user is supported via the left side frame and right side frame.

* * * * *